US005492398A

United States Patent [19]

Schafer

[11] Patent Number: 5,492,398

[45] Date of Patent: Feb. 20, 1996

[54] DUAL MODULAR HINGED ACCESS DISPLAY AND DISPENSING STRUCTURE

[75] Inventor: Christopher E. Schafer, Adair, Iowa

[73] Assignee: Schafer Systems Inc., Adair, Iowa

[21] Appl. No.: 243,819

[22] Filed: May 17, 1994

[51] Int. Cl.[6] ..... B65H 61/00

[52] U.S. Cl. ..... 312/34.7; 206/394

[58] Field of Search ..... 312/34.4, 34.7, 312/34.1, 34.8, 34.22; D20/2; 206/409, 393, 394, 824

[56] References Cited

U.S. PATENT DOCUMENTS

| | | | |
|---|---|---|---|
| D. 319,264 | 8/1991 | Schafer . | |
| 2,738,898 | 3/1956 | Lee | 312/34.4 |
| 3,433,544 | 3/1969 | Monyette et al. | 312/34.4 |
| 4,995,507 | 2/1991 | Schafer . | |
| 5,100,038 | 3/1992 | Schafer . | |
| 5,219,126 | 6/1993 | Schutz | 206/394 |

*Primary Examiner*—Peter M. Cuomo
*Assistant Examiner*—Gerald A. Anderson
*Attorney, Agent, or Firm*—G. Brian Pingel; Brett J. Trout

[57] ABSTRACT

A dual modular device for the display and dispensing of tickets is provided that includes a box type unit with two storage sections and a rear door that is pivotally mounted by a mounting assembly formed of cylindrical posts attached to each lower corner of the door and receivably journaled in cavities located in the lower rear portion of each sidewall of the unit. The door further includes side and top flanges that overlie the sidewalls and roof of the unit when the door is in a closed position to secure the sidewalls of the unit from being forced apart to gain access to the interior of the unit. The lower portion of the door also includes offset side edges to provide a door with approximately the same dimension as the inside measurement between the two sidewalls of the unit so that the lower portion of the door acts as a positioning guide when closing the door.

9 Claims, 4 Drawing Sheets

DUAL MODULAR HINGED ACCESS DISPLAY AND DISPENSING STRUCTURE

SUMMARY OF THE INVENTION

The present invention provides a hinged access display and dispensing structure for use with lottery-type tickets. The structure generally comprises a unit of box-like configuration divided into two storage sections and having a pivotally mounted door at a lower portion of the rear end of the unit by way of cylindrical posts projecting outwardly from each lower corner of the door and receivably journaled in circular cavities located in the lower rear portion of each sidewall.

The lower portion of the unit door is offset forward of the rear edges of the sidewalls so as to line up with the pivot axis, and the width of the offset portion of said door is slightly less than the inside measurement between the two sidewalls so that the lower portion of the door acts as a positioning guide when closing the door. The door further includes side and top flanges extending forwardly to engage the rear edges of the top and sidewalls of the body of the display unit to prevent such sidewalls from being forced apart by unauthorized personnel to gain access to the interior of the display device.

The present invention also includes an exit means with rollers mounted on slotted posts on either side of the exit means such that the tickets are dispensed between each roller and the rearwardly extending cutting edge. Each roller has a throughbore with two diameters for mounting, the first portion having a diameter in close tolerance with the mounting post, and the second portion having a diameter slightly larger then the first diameter. This larger diameter creates a fulcrum effect on each roller toward the midpoint of the roller throughbore, increasing the resiliency of the each roller to allow for the proper dispensing of tickets of various thicknesses.

DETAILED DESCRIPTION OF THE PREFERRED EMBODIMENT

Figure 1:
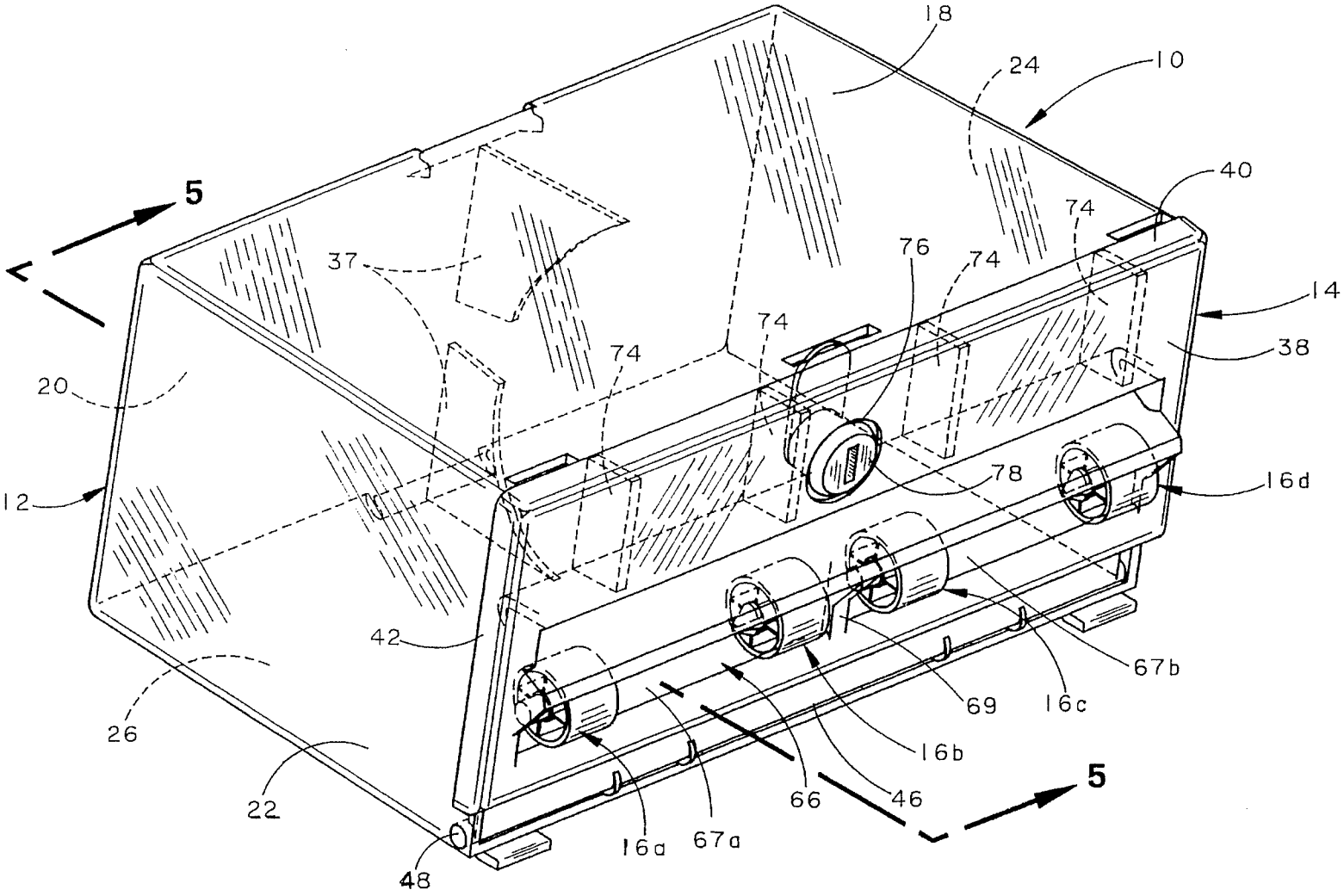
FIG. 1 is a rear perspective view of a preferred embodiment of a dual modular hinged access display and dispensing device of this invention; that includes a pivotally mounted rear door having an exit slot with two pair of rollers.
Figure 3:
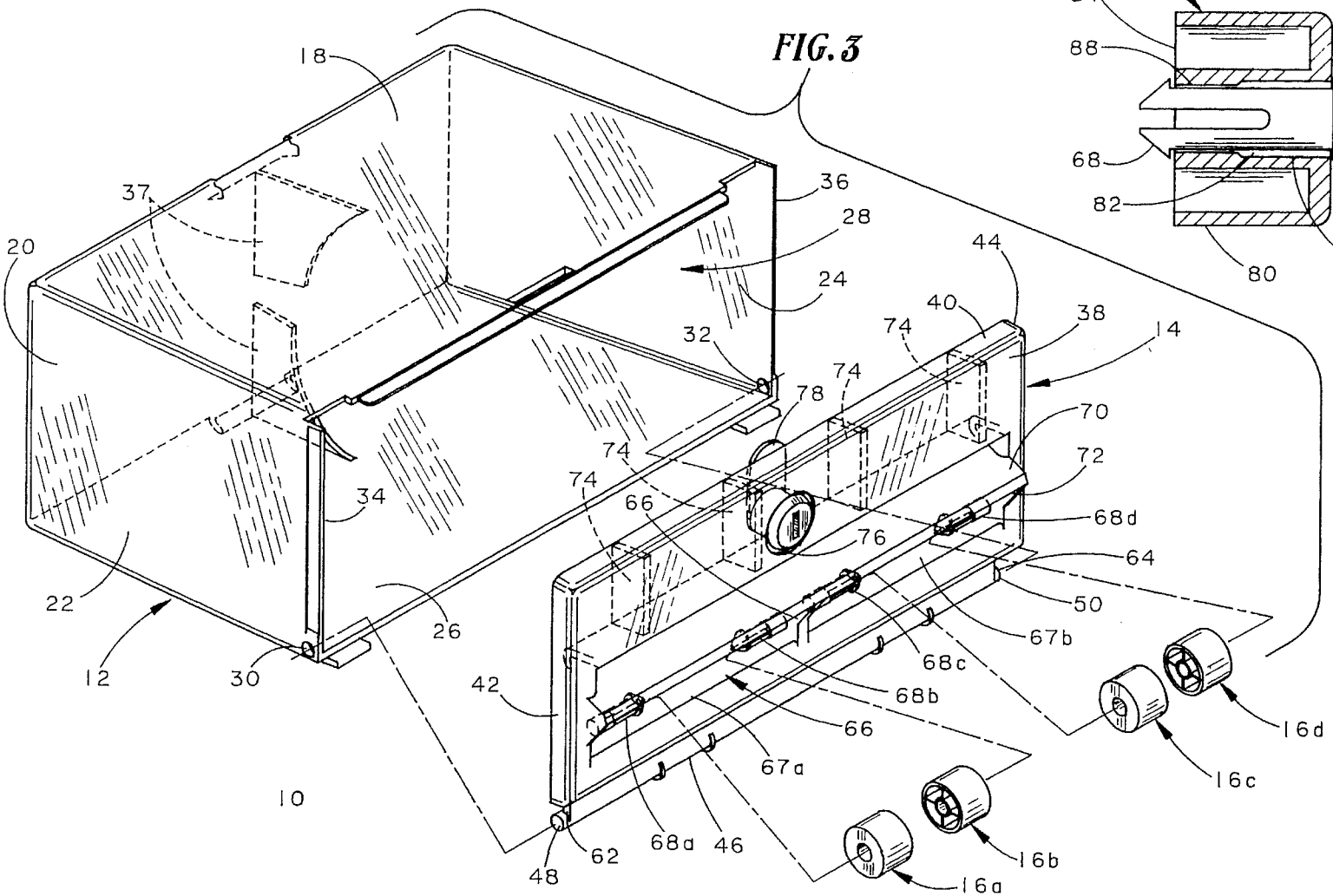
FIG. 3 is an exploded rear perspective view of the preferred embodiment FIG. 1.

With reference to the drawings, a dual modular hinged access ticket display and dispensing device of this invention is indicated generally as 10 in FIG. 1, and includes a box unit 12, a door 14, and four rollers 16*a*, 16*b*, 16*c* and 16*d* (FIG. 3).

The box unit 12 has a top surface 18, a front wall 20, a pair of opposite sidewalls 22 and 24, and a bottom surface 26. As best shown in FIG. 3 a rear opening 28 allows access to the inside of the box unit 12.

Figure 2:
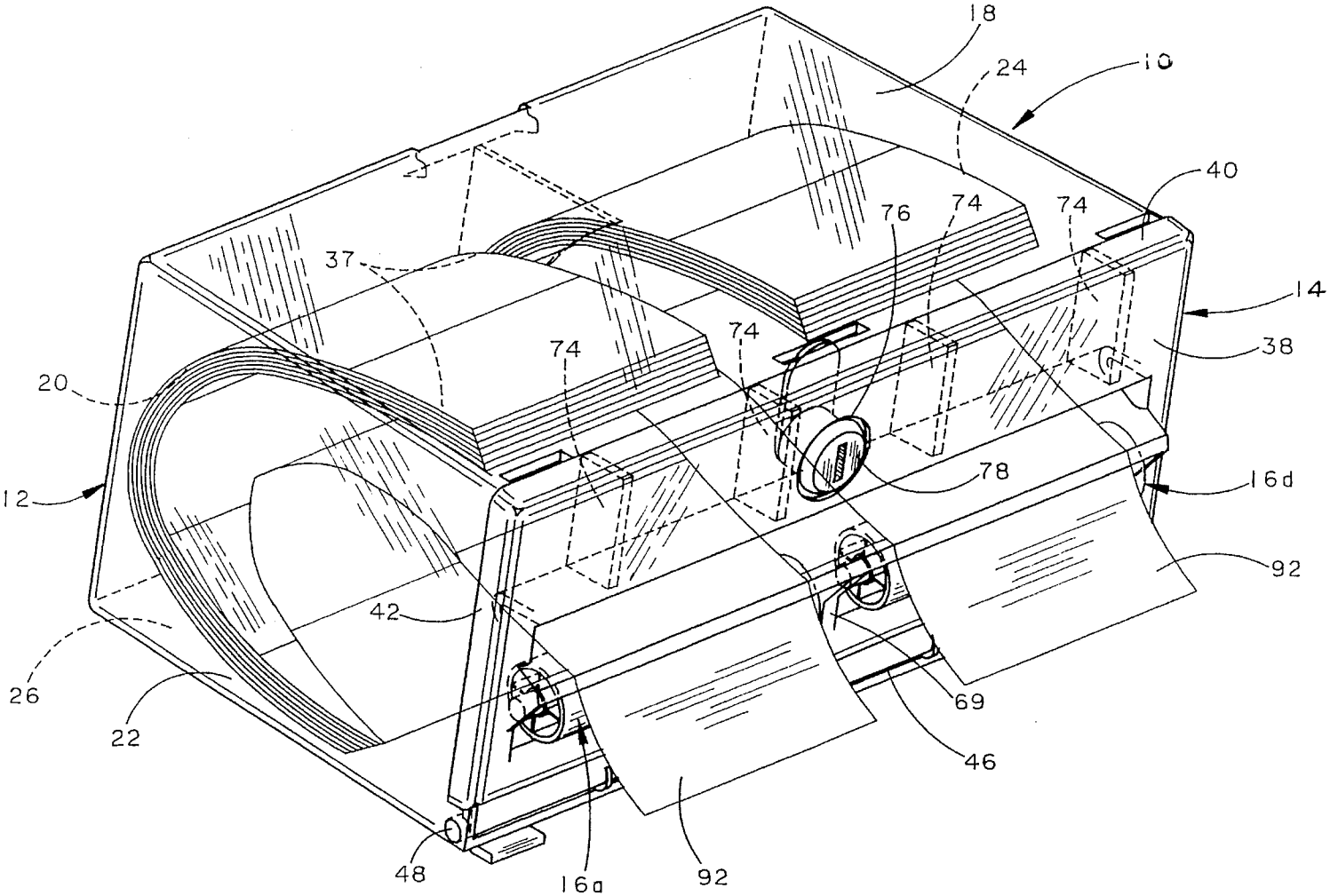
FIG. 2 is a similar view of the preferred embodiment of FIG. 1, with the device shown containing lottery tickets for dispensing.

Referring still to FIG. 3, the bottom rear corner of the sidewalls 22 and 24 are formed with a pair of circular cavities 30 and 32 respectively. A pair of vertical rear edges 34 and 36 of the sidewalls 22 and 24 respectively are somewhat thinner than the typical wall thickness of the sidewalls 22 and 24 for receivably engaging the door 14. Also located within box unit 12 are divider portions 37 to divide the box unit 12 into two storage sections for each receiving a roll of tickets, as indicated by FIG. 2, in a side-by-side relationship.

Figures 4, 5, 6, 7:
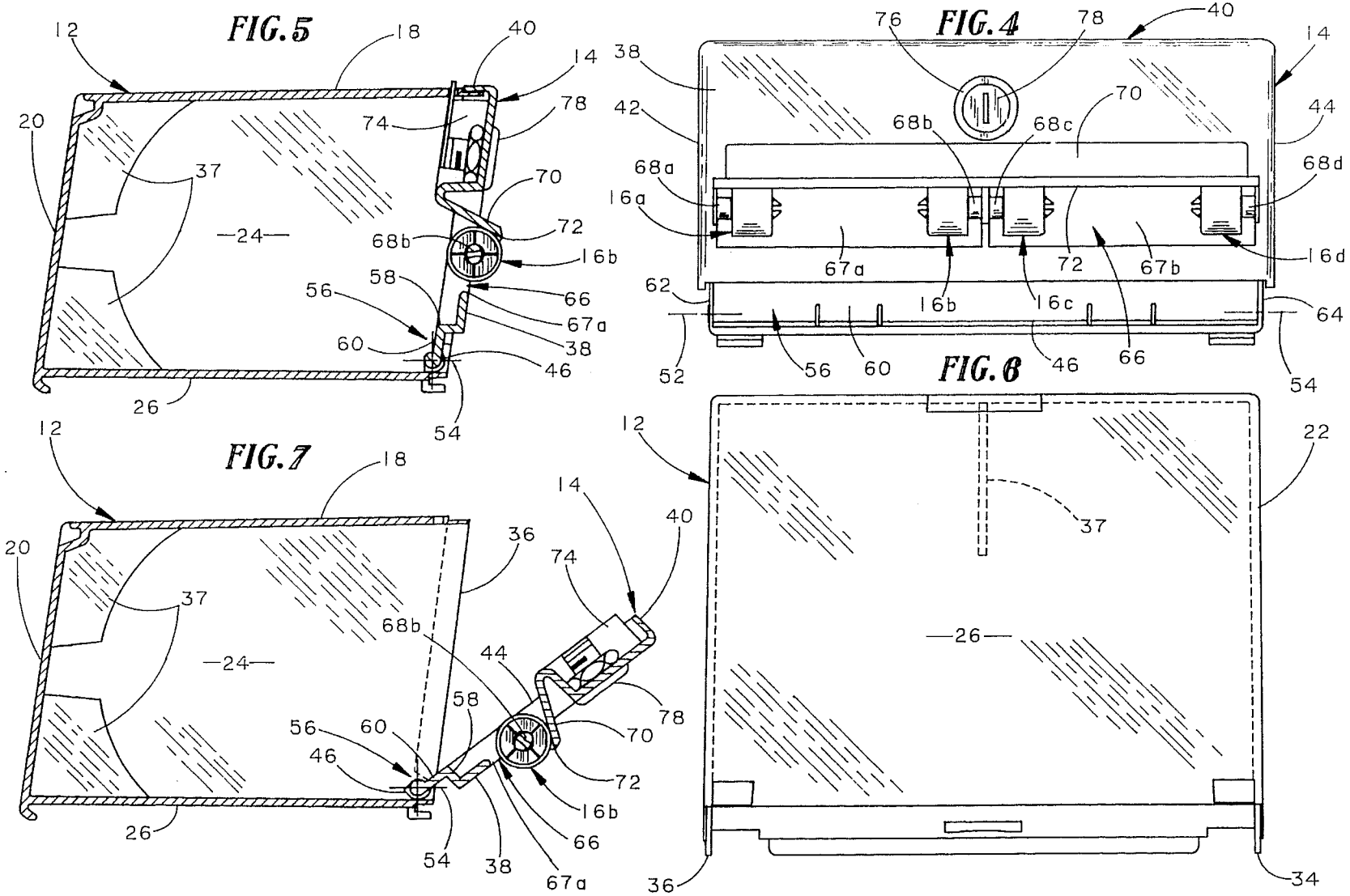
FIG. 4 is a rear elevation view of the preferred embodiment of FIG. 1.
FIG. 5 is a side cross-sectional view of the preferred embodiment of FIG. 1 taken along line 5—5 of FIG. 1.
FIG. 6 is a bottom view of the preferred embodiment of FIG. 1 with the door removed.
FIG. 7 is a side cross-sectional view of the preferred embodiment of FIG. 1 similar to FIG. 5, only with door shown in an open position.

The door 14, as best shown in FIGS. 3 and 4, has a vertical face 38, a horizontal top flange 40 and a pair of vertical side flanges 42 and 44. A bottom edge 46 of the door 14 is generally cylindrical in shape, and has a pair of cylindrical posts 48 and 50 at opposite ends. An integral offsetting member 56 joins the bottom door edge 46 to the vertical door face 38. The cylindrical posts 48 and 50 are designed to be receivably journaled in the circular cavities 30 and 32 of the sidewalls 22 and 24 of the box unit 12, thereby, creating a pair of colinear pivot axes 52 and 54 (as indicated in FIG. 4) for the door 14. As indicated in FIG. 7, the bottom edge 46 of the door 14 is offset forward of the door face 38 by the offsetting member 56 so as to line up with the pivot axes 52 and 54.

The offsetting member 56 is defined by a horizontal portion 58, a vertical portion 60, and a pair of end surfaces 62 and 64 (shown in FIGS. 3 and 4). The distance between the end surfaces 62 and 64 of the offsetting member 56 is slightly less than, but approximately the same as the inside measurement between the sidewalls 22 and 24 of the box unit 12. Preferably there is only a 0.01 inch difference therebetween such that the offsetting member 56 of the door 14 acts as a positioning means for guiding the door 14 during closing thereof.

The dual modular hinged access display and dispensing device 10 is preferably entirely molded of a clear plastic material such as polycarbonate. Such materials have inherent flexible and resilient qualities. Because of such flexible and resilient qualities, the door 14 is pivotally and demountably attachable to the box unit 12.

By flexing the somewhat thinner vertical rear edges 34 and 36 of the sidewalls 22 and 24, the cylindrical door posts 48 and 50 can be snapped into the circular openings 30 and 32 in the box unit sidewalls 22 and 24, thus mounting the door 14 to the box unit 12. Conversely, by similarly flexing the vertical edges 34 and 36, the cylindrical posts 48 and 50 can be unsnapped from the circular openings 30 and 32, thus demounting door 14 from the box unit 12.

When in the door closed position, as shown in FIGS. 1 and 5, the horizontal top flange 40, and the vertical side flanges 42 and 44, of the door 14 overlie and encompass respectively the top surface 18, and the vertical rear edges 34 and 36 of the box unit 12. Accordingly, in such position the flanges 40, 42 and 44 prevent the top surface 18 and the sidewalls 22 and 24 from being forced apart by unauthorized persons attempting to gain access to the interior of the device 10.

The vertical door face 38 is provided with a horizontal opening 66 that extends almost the full width of the door 14.

The opening 66 is divided into two axially aligned slots 67*a* and 67*b* by a wall 69. The slots 67*a* and 67*b* are provided at their ends with slotted posts 68*a*, 68*b*, 68*c* and 68*d* for receiving their rollers 16*a*, 16*b*, 16*c* and 16*d* respectively (FIGS. 3, 4, and 5). As best shown in FIG. 5, the upper surface of the opening 66 is formed by a sloped member 70 that terminates in a relatively sharp beveled edge 72. Four support members 74 protrude from the inner surface of the door 14, and provide support for the top surface 18, of the box unit 12, when the door 14 is closed. Also provided in the vertical face 38 of the door 14 is a hole 76 for installation of a commercially available key actuated cam lock assembly 78.

Figure 8:
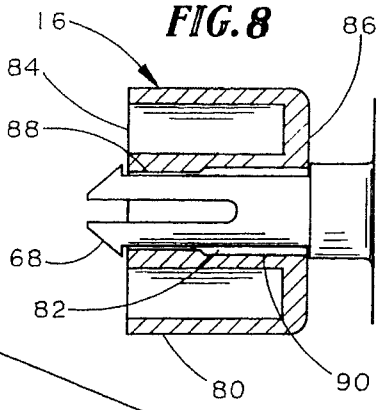
FIG. 8 is an enlarged cross-sectional view of a roller shown slidably mounted to a slotted post of the preferred embodiment of FIG. 1.

The four rollers 16*a*, 16*b*, 16*c* and 16*d* are identical and therefore only one will be described in detail. As best shown in FIG. 8, the roller 16 has an outer surface 80, a throughbore 82, an outer end 84 and an inner end 86. The throughbore 82 is comprised of two different sections, a smaller diameter section 88 and a larger diameter section 90.

The smaller diameter section 88 begins at the outer end 84 and extends approximately one-third the length of the throughbore 82. The larger diameter section 90 begins at the inner end 86 and extends approximately two-thirds the length of the throughbore 82. As shown in FIG. 8, the smaller diameter section 88 of the throughbore 82 has a relatively close fit with the slotted post 68, while the larger diameter section 90 of the throughbore 82 has a relatively loose fit with the slotted post 68.

Because of the loose fit between the section 88 and the post 68, the rollers 16*a*, 16*b*, 16*c* and 16*d* are free to rock on the slotted mounting posts 68*a* and 68*b*. The purpose of such movement is to allow for the dispensing of varying thicknesses of lottery tickets 92 and dimensional variances in the molding process, while at the same time, to apply an even, but not excessive pressure spaced a short distance inward of the sharp cutting edge 72 of the sloped member 70. Any such excessive pressure can remove the coating on the lottery tickets 92 designed to hide the numbers, thus rendering them void. The gap between each roller 16 and the slotted mounting posts 68 creates a fulcrum effect on each roller 16 toward the midpoint of the roller throughbore, increasing the resiliency of each roller 16 and providing for a more even distribution of pressures on the ticket to allow for the proper dispensing of lottery tickets 92 of various thicknesses.

Although the invention has been described with respect to a preferred embodiment thereof, it is to be understood that it is not to be so limited since changes and modifications can be made therein which are within the full intended scope of this invention as defined by the appended claims. For example, it is possible to switch the door posts 48 and 50 with the cavities 30 and 32. Also, it would be possible to extend the width of the device 10, add additional dividers 37, create more openings 67, with posts 68, and rollers 16 to make a device capable of holding more tickets 92 to be dispensed without deviating from the true spirit of the present invention.

I claim:

1. A dual modular hinged access display and dispensing device comprising:

(a) a unit of box-like configuration having a floor, a roof, a pair of sidewalls, a front end and an open rear end;

(b) a divider portion located within said unit to divide said unit into at least two side-by-side storage sections for the material to be dispensed;

(c) a unit door pivotally and demountably attached at a lower portion of the rear end of said unit by way of posts protruding from either the lower corners of said door or the lower portion of the unit sidewalls and cavities journaled in either the lower rear corners of said door or the lower portion of the sidewalls wherein the door unit is provided with a lower portion offset forward of the rear edges of the units sidewalls so as to line up with the pivot axis of the door, with the width of the offset portion of said door being slightly less than but approximately the same as an inside measurement between the two sidewalls to allow the lower portion of said door to act as a positioning guide when closing said door; and (d) means for semi-permanently attaching the door to the opposite upper portion of the rear end of said unit so that the door serves as a rear wall for said unit when in a closed position.

2. A display device according to claim 1 wherein the cylindrical posts are of such size and the unit sidewalls are formed of a material having sufficient flexibility and resiliency to allow for the mounting of said door to and demounting of said door from said unit by hand without adversely affecting the structural integrity of the pivotal attachment.

3. A display device as recited in claim 1 wherein said divider portion is medially located in said unit to divide said unit into two storage sections.

4. A display device according to claim 1 that further includes the unit door having flanges on each vertical edge of said door that extend forward to overlie the rear edges of the unit sidewalls.

5. A display device according to claim 1 wherein said posts are formed as part of the door and said cavities are formed as part of the unit sidewalls.

6. A display device according to claim 5 wherein said posts and cavities are cylindrically shaped.

7. A display device according to claim 1 that further includes the unit door having a flange on the top that extends forwardly to overlie the rear edge of the unit roof.

8. A dual modular hinged access display and dispensing device comprising:

(a) a unit of box-like configuration having a floor, a roof, a pair of sidewalls, a front end and an open rear end;

(b) a divider portion located within said unit to divide said unit into at least two side-by-side storage sections for the material to be dispensed;

(c) a unit door pivotally and demountably attached at a lower portion of the rear end of said unit by way of posts protruding from either the lower corners of said door and the unit sidewalls or the lower portion cavities journaled in either the lower rear corners of said door or the lower portion of the sidewalls, said unit door having a horizontally aligned exit means having sidewalls and a top edge extending outwardly from an outer surface of said door;

(d) a slotted post fixedly attached to each said exit means sidewall;

(e) a roller slidably mounted on each of the slotted posts, said roller having an axial through bore with a first portion of the length of the bore having a diameter in close tolerance with the slotted post and a second portion of the length of the bore having a diameter somewhat larger than the first diameter to increase the resiliency of said roller; and (f) means for semi-permanently attaching the door to the opposite upper portion of the rear end of said unit so that the door serves as a rear wall for said unit when in a closed position.

9. A dual modular hinged access display and dispensing device comprising:

(a) a unit of box-like configuration having a floor, a roof, a pair of sidewalls, a front end and an open rear end;

(b) a divider portion located within said unit to divide said unit into at least two side-by-side storage sections for the material to be dispensed;

(c) a unit door pivotally and demountably attached at a lower portion of the rear end of said unit by way of posts protruding from either the lower corners of said door or the portion of the unit sidewalls and cavities journaled in either the lower rear corners of said door or the lower portion of the sidewalls, wherein in the unit door is provided with flanges on each vertical edge of said door that extend forward to overlie the rear edges of the unit sidewalls a sufficient distance to prevent outward biasing of the sidewalls sufficient to remove said posts from said cavities located in said sidewalls when the unit door is in a closed position, and wherein said flanges do not overlie said cavities a sufficient distance to prevent outward biasing of the sidewalls a sufficient distance to insert said posts into said cavities when unit door is in an open position; and (d) means for semi-permanently attaching the unit door to an opposite upper portion of the rear end of said unit so that the unit door serves as a rear wall for said unit when the unit door is in said closed position.

* * * * *